US007314039B2

(12) United States Patent
Toniato

(10) Patent No.: US 7,314,039 B2
(45) Date of Patent: Jan. 1, 2008

(54) METHOD OF CONTROLLING OPERATION OF A LIQUID-FUEL COMBUSTION APPLIANCE

(75) Inventor: Giuseppe Toniato, Legnago (IT)

(73) Assignee: Riello S.p.A., Legnago (IT)

( * ) Notice: Subject to any disclaimer, the term of this patent is extended or adjusted under 35 U.S.C. 154(b) by 93 days.

(21) Appl. No.: 11/288,575

(22) Filed: Nov. 29, 2005

(65) Prior Publication Data

US 2006/0138248 A1 Jun. 29, 2006

(30) Foreign Application Priority Data

Dec. 1, 2004 (EP) ..... 04425907

(51) Int. Cl.
*F02M 37/04* (2006.01)
*F04B 49/00* (2006.01)

(52) U.S. Cl. ..... 123/497; 417/12; 237/80

(58) Field of Classification Search ..... None
See application file for complete search history.

(56) References Cited

U.S. PATENT DOCUMENTS 4,212,601 A * 7/1980 Ina ..... 417/365
5,163,324 A * 11/1992 Stewart ..... 73/302
5,240,179 A * 8/1993 Drinkwater ..... 237/80
5,444,360 A * 8/1995 Drinkwater ..... 323/265
6,283,173 B1 * 9/2001 Osborne ..... 141/83
2003/0183205 A1 * 10/2003 Mudway et al. ..... 123/497
2004/0000595 A1 1/2004 Munzner et al. ..... 237/12.3 C
2006/0275135 A1 * 12/2006 Nation et al. ..... 417/12

FOREIGN PATENT DOCUMENTS

EP 1 006 316 10/2002
JP 59-231316 12/1984

* cited by examiner

*Primary Examiner*—Thomas Moulis
(74) *Attorney, Agent, or Firm*—Baker & Daniels LLP

(57) ABSTRACT

A method of controlling operation of a liquid-fuel combustion appliance. The method is characterized by including an "antiseize operating mode" in which an electric motor and a fuel pump, powered by the electric motor, are started periodically to prevent oxidation and/or polymerization of the liquid fuel in the fuel pump when the fuel pump is idle. More specifically, the fuel pump is a gear pump.

17 Claims, 1 Drawing Sheet

METHOD OF CONTROLLING OPERATION OF A LIQUID-FUEL COMBUSTION APPLIANCE

The present invention relates to a method of controlling operation of a liquid-fuel combustion appliance.

BACKGROUND OF THE INVENTION

Combustion appliances are known comprising at least one pump for feeding liquid fuel to at least one liquid-fuel atomizing head.

More specifically, burners or heating units have at least one pump for drawing fuel from a tank and feeding it under pressure to at least one nozzle where the liquid is atomized and made suitable for combustion (mechanical atomization).

Given the high pressures (5-20 bars) and low flow rates involved, the pumps are normally volumetric types.

Gear-type volumetric pumps are the most commonly used.

In pumps of this sort, one gear is driven by an electric motor, and in turn drives an idle second gear; and the liquid flows through an intake port into one of the cavities formed by the teeth of the two gears, and is discharged to the delivery port while gradually increasing in pressure.

The two gears and the seat in which they operate must be machined accurately to ensure optimum performance of the pump.

Moreover, the mechanical assembly defined by the two gears is lubricated by the pumped fuel itself.

When the pump is idle, however, fuel remains trapped inside the cavities formed by the geometry of the gears.

In certain conditions, and if the pump remains idle for any length of time, the fluid film deposited inside the cavities undergoes oxidation and/or polymerization, thus resulting in alteration of its properties, in particular viscosity.

When this happens, the fluid deposit may assume such a consistency as to prevent rotation of the gears when the pump is started up again.

That is, the starting torque of the electric motor is no longer enough to overcome the breakaway friction torque produced by the high-viscosity fluid deposit.

One of the causes of the problem is the addition of vegetable fuel to the mineral fuel.

Vegetable fuel may comprise unsaturated polymer chains, which, in the presence of oxygen or during prolonged stoppages, may combine to form macromolecules, the relative flow properties of which are greatly inferior to those of non-oxidized fuel.

SUMMARY OF THE INVENTION

It is an object of the present invention, therefore, to provide a method of controlling operation of a liquid-fuel burner, whereby the fuel pump is operated periodically to prevent seizing of the pump caused by polymerization of the fuel.

The liquid fuel, normally gas oil for heating, is pumped by the gear pump to two conduits formed inside the pump.

A first conduit is normally closed by a safety valve controlled by a central control unit; while a second conduit is fitted inside with a pressure regulator for maintaining a user-defined fuel pressure.

When heat demand (closure of the thermostat) starts the burner, this performs a predetermined operating sequence.

That is, the electric motor starts the fuel pump, which sets the circuit to the pressure set by the pressure regulator; and, when the pressure regulator opens, all the fuel flows back to the tank via the pressure regulator.

After a given length of time, a central control unit excites the delivery valve, and part of the fuel flows to the nozzle.

Actual operation commences when the flame is lit, as detected by a sensor.

As stated, start-up is determined by heat demand (closure of the thermostat) by the outside environment.

It is an object of the present invention to provide a combustion appliance operating mode distinct from the operating mode described above.

For the sake of clarity, in the following description, the term "standard operating mode" refers to the mode described above, and the term "antiseize operating mode" to a new mode on which the method which is the main object of the present invention is based.

When the combustion appliance operates in "antiseize operating mode", the electric motor and the fuel pump are operated periodically so that fuel flows from the tank to the pump and from the pump back to the tank, but is never fed to or atomized by the nozzle.

The purpose of this mode, in fact, is to prevent an increase in the viscosity of the liquid fuel in the pump when the pump is idle.

"Antiseize operating mode" may be either "periodical" (possibly performed at intervals determined by an electronic central control unit as a function of typical fuel parameters and the particular type of combustion appliance), or "random", in which case, the electronic central control unit governing the combustion appliance generates random checks.

The following is a more detailed description of the "antiseize operating mode" and the differences between this and the "standard operating mode".

"Standard operating mode" is always and only activated by closure of the thermostat, whereas "antiseize operating mode" can only be activated when the burner is left idle for a prolonged period of time.

A device associated with the burner determines the time lapse since the last heat demand, and accordingly sets the burner to "antiseize operating mode".

"Standard operating mode" comprises a sequence of operations, including exciting an appropriate valve and feeding fuel to the nozzle where it is atomized. In "antiseize operating mode", on the other hand, no valve is excited, and the fuel is never supplied to the nozzle, but is circulated from the tank to the pump and from the pump back into the tank.

Moreover, in "antiseize operating mode", the electric motor and pump are started and stopped with a frequency as determined by the electronics of the burner, whereas, in "standard operating mode", operating frequency coincides with the frequency with which the thermostat closes, as determined by environmental conditions.

In "standard operating mode", the electric motor always rotates in the same direction, whereas, in "antiseize operating mode", the electronic devices controlling the combustion appliance can choose either rotation direction, depending on the antiseize function required.

It should be noted that "antiseize operating mode" is subordinate to "standard operating mode", in the sense that, if heat demand (closure of the thermostat) occurs while "antiseize operating mode" is activated, the system switches to "standard operating mode".

"Antiseize operating mode" may be activated at the user's discretion, and may be user-deactivated by means of an appropriate selector if not required by the system, e.g. on account of fuel containing particular antiseize compositions being used.

According to the present invention, therefore, there are provided a method and relative appliance as claimed in the attached Claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
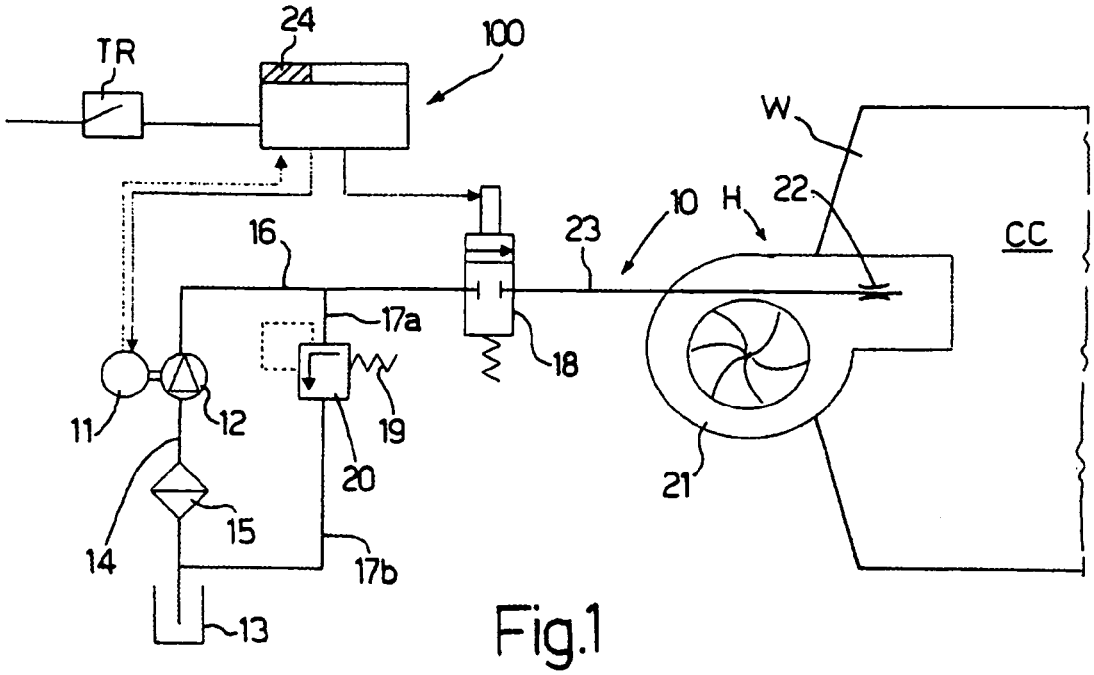
FIG. 1 shows a first embodiment of a combustion appliance for implementing the innovative method which is the main object of the present invention.

Number 10 in FIG. 1 indicates as a whole a combustion appliance for implementing the innovative method which is the main object of the present invention (see below).

In "standard operating mode", heat demand by the outside environment closes a thermostat TR.

An electric signal is therefore sent to an electronic central control unit 100 for controlling all the operations performed by appliance 10.

Central control unit 100 controls operation of an electric motor 11 powering a gear pump 12.

Fuel is drawn by gear pump 12 from a tank 13 along an intake conduit 14 and via a filter 15.

The fuel then flows along a conduit 16 closed by a normally-closed valve 18, and along a conduit 17*a*.

When the fuel pressure reaches such a value as to activate a spring 19 of a regulating device 20 along conduit 17*a*, device 20 opens to drain the fuel into tank 13 along a conduit 17*b*.

For a few seconds, therefore, all the fuel pumped by pump 12 flows into tank 13 via regulating device 20 and along conduits 17*a* and 17*b*.

This is what is known as the "pre-ventilation stage", in that, during this time interval, electric motor 11, in addition to operating gear pump 12, also starts a fan 21 to expel any unburnt gases from a combustion chamber CC.

At the end of the "pre-ventilation stage", electronic central control unit 100 opens valve 18, so that part of the fuel flows along a conduit 23 to a nozzle 22, and the pressurized liquid fuel is atomized by nozzle 22 and mixed with the air supplied by fan 21.

Fan 21 and nozzle 22 together form a combustion head H fitted to a wall W of combustion chamber CC.

A heat source (not shown in FIG. 1) inside combustion chamber CC ignites the fuel/air mixture issuing from combustion head H.

Lighting of the flame is detected by a sensor (not shown in FIG. 1), which informs electronic central control unit 100 that the fuel/air mixture has been ignited and the flame lit.

In the event the fuel/air mixture is not ignited, central control unit 100 closes valve 18 to cut off fuel flow to combustion head H.

What has been described so far is the "standard operating mode" common to numerous currently marketed combustion appliances.

As stated, one of the objects of the present invention is to provide, in addition to the above "standard operating mode", a second so-called "antiseize operating mode".

Electronic central control unit 100 is therefore designed to start electric motor 11, and therefore gear pump 12, regardless of the actual heat demand of the environment.

For this purpose, a timer 24—preferably, though not necessarily, an internal device of central control unit 100—is provided.

The function of timer 24 is to measure the time lapse since the last heat demand.

When the time lapse exceeds a given value set by the user in central control unit 100, central control unit 100 starts the electric motor 11 and, therefore, pump 12.

The liquid fuel therefore flows through the gear assembly of pump 12 in tank 13, through regulating device 20, and along conduits 17*a*, 17*b*. This stage is only followed by excitation of valve 18 if, in the meantime, a heat demand is received from thermostat TR to set electronic central control unit 100 to the "standard operating mode" described previously.

If no heat demand by the environment occurs, electronic central control unit 100 stops electric motor 11 and, therefore, combustion appliance 10.

After a given time lapse, providing no heat demand is made by the outside environment, the above procedure is repeated in exactly the same way.

In other words, "antiseize operating mode" is subordinate to "standard operating mode" when heat demand is made by the environment.

Electronic central control unit 100 starts electric motor 11, which in turn starts pump 12, through which fuel flows for a given time, and the system is then stopped.

Obviously, the purpose of starting and stopping electric motor 11 is to prevent the liquid fuel from settling for a prolonged period inside the gaps between the gears of pump 12.

If the gear assembly of pump 12 should seize despite repeated on-off cycles, a temperature sensor (not shown in FIG. 1) provides for thermal protection of electric motor 11, and informs electronic central control unit 100 of seizure of pump 12.

By means of an appropriate selector (not shown in FIG. 1), "antiseize operating mode" may be deactivated by the user when not required by the heating system or the liquid fuel used. In which case, the heating system operates solely in "standard operating mode".

Activation of electric motor 11 and pump 12 is so programmed as to rotate electric motor 11 and pump 12 first clockwise then immediately anticlockwise, or vice versa.

Figure 2:
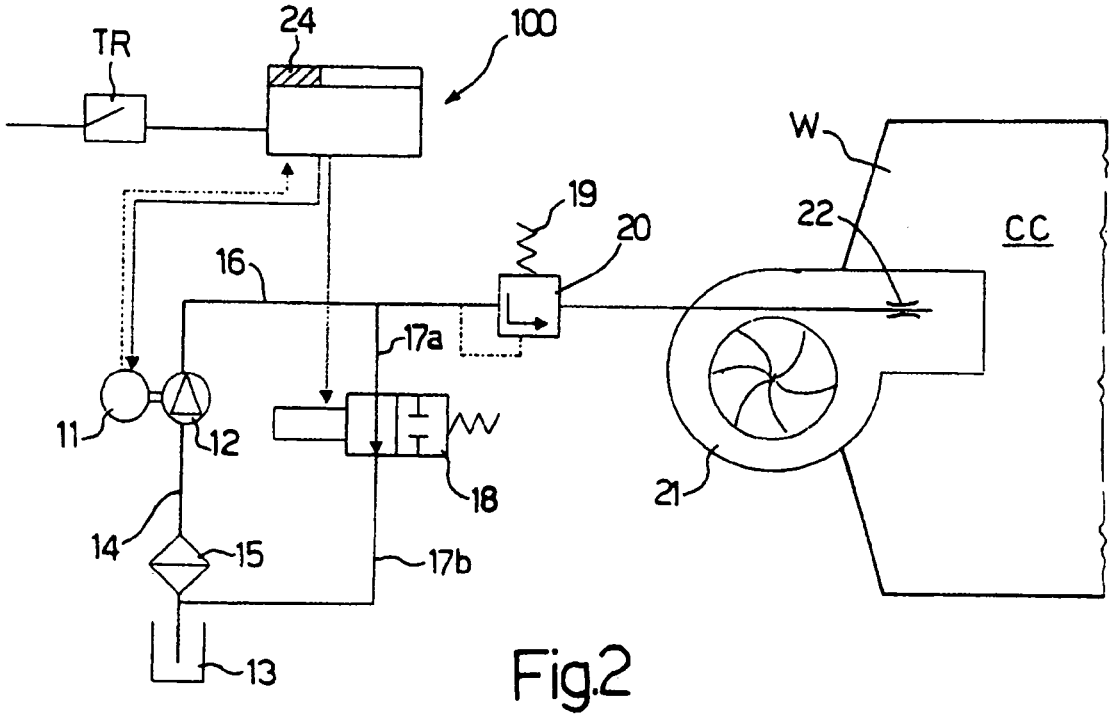
FIG. 2 shows a second embodiment of a combustion appliance for implementing the innovative method which is the main object of the present invention.

FIG. 2 shows a further embodiment of the present invention.

More specifically, in this case, regulating device 20 is fitted along conduit 16, and valve 18 along conduits 17*a*, 17*b*.

Also, valve 18 is normally open.

When heat is demanded by the environment (closure of thermostat TR), electroni central control unit 100 starts electric motor 11, and gear pump 12, powered by electric motor 11, pumps liquid fuel along conduits 17*a*, 17*b* into tank 13. At this stage, liquid-fuel flow along conduit 16 is prevented by regulating device 20, which the fuel pressure is not high enough to activate.

After the above pre-ventilation stage, electronic central control unit 100 closes valve 18, the pressure along conduit 16 rises, regulating device 20 opens, and fuel flows to head H.

As in the FIG. 1 embodiment, in this case too (FIG. 2), the present invention provides for an additional so-called "antiseize operating mode".

When "antiseize operating mode" is activated, electronic central control unit 100, in the absence of heat demand, starts electric motor 11 and pump 12 with a given frequency to pump fuel through valve 18, and, if no heat demand is made in the meantime, stops electric motor 11 and pump 12.

In this case too, seizure of pump 12 is indicated by means of electronic central control unit 100.

FIGS. 1 and 2 show so-called "two-pipe" combustion appliances.

The same, however, obviously also applies to "single-pipe" appliances, in which one pipe connects the tank to the burner circuit.

In these applications, the outlet conduit from the regulating device and the outlet conduit from the valve are formed inside the pump.

In real applications, valve 18 and regulating device 20 may be formed inside the body of pump 12.

The invention claimed is:

1. A method of controlling operation of a liquid-fuel combustion appliance, the method comprising an "antiseize operating mode" in which an electric motor and a fuel pump, powered by said electric motor, are started periodically to prevent oxidation and/or polymerization of the liquid fuel in said fuel pump when said fuel pump is idle; wherein activation of said electric motor and said fuel pump is so programmed as to rotate said electric motor and said fuel pump first clockwise and then immediately anticlockwise, or vice versa.

2. A method as claimed in claim 1, wherein said electric motor and said fuel pump are started periodically after predetermined time lapses.

3. A method as claimed in claim 2, wherein the predetermined time lapses are established as a function of the characteristics of the liquid fuel used in said combustion appliance.

4. A method as claimed in claim 1, wherein said electric motor and said fuel pump are started periodically in random manner.

5. A method as claimed in claim 1, wherein if any of the elements of said fuel pump seize, despite repeated on-off cycles of said electric motor and said fuel pump, such seizure is indicated in the form of an alarm.

6. A method as claimed in claim 1, also comprising selective connection and disconnection of said "antiseize operating mode".

7. A method as claimed in claim 1, wherein said "antiseize operating mode" is subordinate to a "standard operating mode" in the event of heat demand by the environment.

8. A liquid-fuel combustion appliance comprising: an electric motor for powering a fuel pump; a feed network for feeding liquid fuel from a tank to a combustion head; disabling means for disabling fuel flow to said combustion head; diverting means for diverting liquid-fuel flow from said feed network back to said tank; electronic control means; and activating means activated periodically to prevent oxidation and/or polymerization of the liquid fuel in said fuel pump when said fuel pump is idle; wherein said activating means is so programmed as to rotate said electric motor and said fuel pump first clockwise and then immediately anticlockwise, or vice versa.

9. An appliance as claimed in claim 8, wherein said activating means periodically activate said disabling means for disabling fuel flow to said combustion head (H), and periodically activate said diverting means for diverting liquid-fuel flow from said feed network back to said tank.

10. An appliance as claimed in claim 8, wherein said activating means are activated after predetermined time lapses, as a function of the characteristics of the liquid fuel used.

11. An appliance as claimed in claim 8, wherein said activating means are activated periodically in random manner.

12. An appliance as claimed in claim 8, wherein if any of the elements of said fuel pump seize, despite repeated on-off cycles of said activating means, such seizure is indicated in the form of an alarm.

13. An appliance as claimed in claim 8, comprising means for selectively connecting or disconnecting an "antiseize operating mode".

14. An appliance as claimed in claim 8, wherein said "antiseize operating mode" is subordinate to a "standard operating mode" in the event of heat demand by the environment.

15. An appliance as claimed in claim 8, wherein said fuel pump is a gear pump.

16. A method of controlling operation of a liquid-fuel combustion apparatus, the method comprising an "antiseize operating mode" in which an electric motor and a fuel pump, powered by said electric motor, are started periodically to prevent oxidation and/or polymerization of the liquid fuel in said fuel pump when said fuel pump is idle; wherein activation of said electric motor and said fuel pump is so programmed as to rotate said electric motor and said fuel pump first clockwise and then immediately anticlockwise, or vice versa.

17. A liquid-fuel combustion appliance comprising: an electric motor for powering a fuel pump; a feed network for feeding liquid fuel from a tank to a combustion head; disabling means for disabling fuel flow to said combustion head; diverting means for diverting liquid-fuel flow from said feed network back to said tank electronic control means and activating means activated periodically to prevent oxidation and/or polymerization of the liquid fuel in said fuel pump when said fuel pump is idle; wherein if any of the elements of said fuel pump seize, despite repeated on-off cycles of said activating means, such seizure is indicated in the form of an alarm.

* * * * *